US009038209B1

(12) United States Patent
Wise

(10) Patent No.: US 9,038,209 B1
(45) Date of Patent: May 26, 2015

(54) SHOWER CURTAIN ROD ASSEMBLY

(76) Inventor: Robert W. Wise, Petaluma, CA (US)

( * ) Notice: Subject to any disclaimer, the term of this patent is extended or adjusted under 35 U.S.C. 154(b) by 826 days.

(21) Appl. No.: 12/804,767

(22) Filed: Jul. 27, 2010

Related U.S. Application Data

(62) Division of application No. 11/595,761, filed on Nov. 9, 2006, now Pat. No. 7,770,243.

(51) Int. Cl.
*A47K 3/38* (2006.01)
*A47H 13/02* (2006.01)

(52) U.S. Cl.
CPC . *A47K 3/38* (2013.01); *A47H 13/02* (2013.01)

(58) Field of Classification Search
USPC ..... 4/557, 558, 607–610; 160/196.1, 345, 160/DIG. 6; 248/261, 264, 268, 200.1; 16/87.2, 87.4 R, 87.6 R; 211/105.1, 211/105.3, 123, 199.009
See application file for complete search history.

(56) References Cited

U.S. PATENT DOCUMENTS

| | | | | |
|---|---|---|---|---|
| 2,173,993 | A | 2/1939 | Amdur | |
| 2,188,163 | A * | 1/1940 | Sherman | 160/327 |
| 3,382,507 | A | 5/1968 | Micheau | |
| 3,808,610 | A | 5/1974 | Mortensen | |
| 3,881,218 | A * | 5/1975 | Palmer | 16/93 D |
| 4,496,059 | A | 1/1985 | Leiter | |
| 4,754,504 | A | 7/1988 | Cellini | |
| 5,007,120 | A | 4/1991 | Annand | |
| 5,103,531 | A | 4/1992 | Perrotta | |
| 5,345,623 | A | 9/1994 | Dearman | |
| 5,421,393 | A | 6/1995 | Wolfe | |
| 5,732,420 | A | 3/1998 | Micciche | |
| 5,771,504 | A | 6/1998 | Steiner | |
| D397,928 | S | 9/1998 | Wise | |
| 5,822,810 | A * | 10/1998 | Chen | 4/610 |
| 6,163,899 | A | 12/2000 | Leonard | |
| 6,195,816 | B1 | 3/2001 | Glassman | |
| 6,216,287 | B1 | 4/2001 | Wise | |
| 6,499,708 | B1 * | 12/2002 | Cowen | 248/261 |
| 6,591,432 | B1 | 7/2003 | Feinstein et al. | |

* cited by examiner

*Primary Examiner* — Janie Christiansen
(74) *Attorney, Agent, or Firm* — Lowe Graham Jones PLLC

(57) ABSTRACT

A shower curtain-rod assembly is arranged to have distinct and structurally separate gravitational and torsional load bearing capabilities. The shower curtain may be formed with folded pockets to receive shower curtain stays. The pockets are made by creating overlapping layers of the shower curtain and then ultrasonically welding the overlapping layers together. The shower curtain-rod assembly includes a shower rod having an internal track, a shower ring coupled to a shower curtain stay, and rollers supported on the internal track and coupled to the stay. The internal track generally supports the weight of the shower curtain, the rollers, the stays, and the shower ring. In one embodiment, a channel formed in an outer wall of the shower rod cooperates with a torsional restraint tab extending from an inner surface of the shower ring, which is located over the shower rod.

16 Claims, 8 Drawing Sheets

SHOWER CURTAIN ROD ASSEMBLY

CROSS REFERENCE TO RELATED APPLICATIONS

This application is a divisional of prior, U.S. patent application Ser. No. 11/595,761, titled SHOWER CURTAIN ROD ASSEMBLY, filed Nov. 9, 2006 now U.S. Pat. No. 7,770,243. This divisional application claims the benefit of the filing date of said prior application under 35 U.S.C. §120.

FIELD OF THE INVENTION

This invention relates generally to shower curtain-rod assemblies. More specifically to shower curtain-rod assemblies for maintaining a shower curtain in a spaced apart configuration with respect to a shower user.

BACKGROUND OF THE INVENTION

Various systems and assemblies exist for covering a shower stall region with a flexible shower curtain to prevent shower water from ending up on the floor of the bathroom. A conventional shower stall or tub region is generally not very large. Thus, a common issue for many bathers occurs when the flexible shower curtain is drawn in toward the bather due to a pressure differential across the shower curtain. This problem occurs because the hot water in the shower heats up the air in the tub region. As the hot air rises, a partial vacuum is created inside the tub region, which results in a pressure differential over the shower curtain, where the pressure on the inside of the curtain is lower than the pressure on the outside of the curtain, thus creating a net force that urges the shower curtain inward toward the bather.

For many reasons, bathers prefer not to have the shower curtain intrude on their bathing space, which includes the bather coming into contact with the inside surface of the shower curtain. For some, one reason may be the cleanliness of the shower curtain, especially in a hotel setting. For others, one reason may be the decreased space to maneuver in the shower.

In an attempt to maintain the shower curtain in a spaced apart relationship with respect to the bather and to create more room in the conventional shower stall or tub region, many designs, such as the design disclosed in U.S. Pat. No. 4,754,504 to Cellini have focused on curved or bowed shower rods. Conventional designs utilize a free hanging shower curtain, while some more recent designs disclose intermediate, horizontal rods (U.S. Pat. No. 5,103,531 to Perrotta) or semi-rigid, curved, vertically-oriented ribs (U.S. Pat. No. 5,771,504 to Steiner) to insure that the shower curtain does not get drawn into the showering region during bathing. In these designs, the shower curtain and/or ribs are coupled to the shower rod with circular or oval-shaped shower rings. One drawback of these designs and other known shower systems utilizing flexible shower curtains is that shower rings are in simple, direct, sliding contact with the shower rod. This simple, direct contact may result in a high friction engagement between the shower rod and the shower rings, which over time causes the shower curtain to weaken and eventually tear in the vicinity of the rings.

Steiner attempts to address the problem of the shower curtain rotating inward toward the bather by employing weights, rib hooks that engage the side of the tub, or rib ends that engage a separate rod located just above the side of the tub. However, these solutions are more complicated both in terms of installation and operation and additional load is still transferred to the shower curtain, which again may eventually lead to tearing of the shower curtain near the shower rings.

In view of the aforementioned shower covering systems, a need exists for an efficient and inexpensive shower curtain-rod assembly that facilitates transverse sliding of the curtain when opening and closing the same, and which also prevents the shower curtain itself from rotating inward toward the bather. A further need arises for a shower curtain that resists tearing.

SUMMARY OF THE INVENTION

It is therefore one objection of the present invention to provide for a shown curtain-rod assembly that substantially de-couples transitional loading from gravitational loading with respect to the shown rod.

It is a further object of the invention to achieve the above objects in a shower curtain that resists tearing, such as a reinforced shower curtain.

The present invention achieves the above objects and advantages, and other objects and advantages that will become apparent from the following description, by providing a shower curtain-rod assembly having a shower curtain that resists tearing and a rod with separate gravitational (e.g., weight) and torsional load bearing capabilities. The shower curtain may be formed with folded pockets to receive shower curtain stays. The pockets are made by creating overlapping layers of the shower curtain and then ultrasonically welding the overlapping layers together.

In a preferred embodiment, the shower curtain-rod assembly includes a shower rod having an internal track, a shower ring coupled to a shower curtain stay, and rollers supported on the internal track and coupled to the stay. The internal track provides the load carrying capability by supporting the weight of the shower rod, shower curtain, the rollers, the stays, and the shower rings. A channel formed in an outer wall of the shower rod reacts against torsional loads applied to the shower rod by cooperating with a torsional restraint tab located on and extending from an inner surface of the shower ring, which is sized to slide along the shower rod in a spaced apart relationship. The shower curtain-rod assembly may include a shower rod with an internal track configuration coupled to a number of stays having a predetermined curvature that provides desired maneuvering space within the shower region. The stays are coupled to the rollers supported on an internal track mechanism of the shower rod. The shower curtain includes ultrasonically welded pockets to receive the stays.

As will be readily appreciated from the foregoing summary, the invention provides a shower curtain-rod assembly having separate load and torsional bearing capabilities resulting from the arrangement of the shower curtain stays, the shower rings, and the shower rod. In addition, the shower curtain of the shower-curtain-rod assembly is easier to move along the shower rod and resists tearing.

DETAILED DESCRIPTION OF THE PREFERRED EMBODIMENTS

Figure 1:
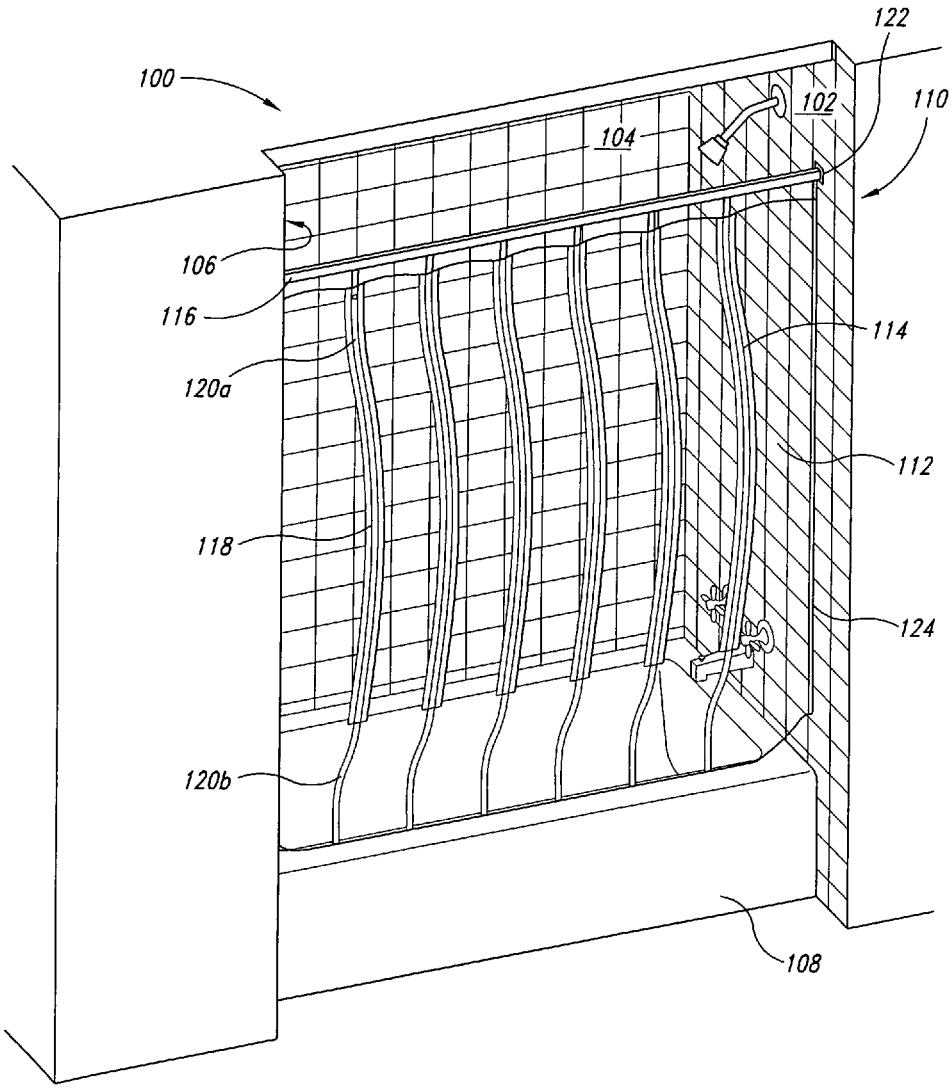
FIG. 1 is perspective, environmental view of a shower stall or tub region having a shower curtain-rod assembly with stays to slideably support a shower curtain along a shower rod in accordance with an embodiment of the invention.
Figure 2:
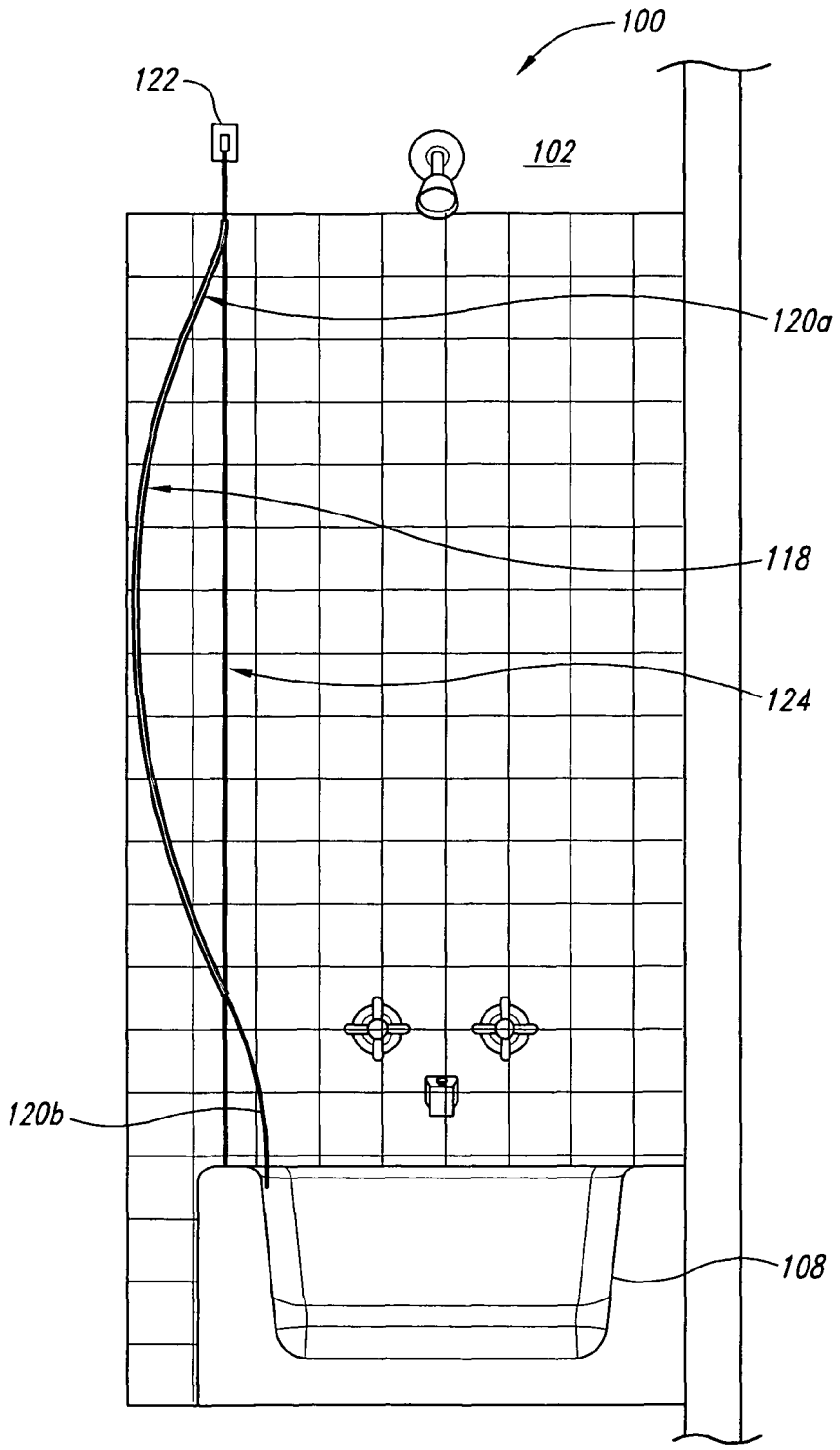
FIG. 2 is a side elevational view of the shower stall region of FIG. 1.

FIGS. 1 and 2 show a shower stall or tub region generally indicated as reference numeral 100, which may be part of a typical residential bathroom. The shower region 100 generally includes a front wall 102 where the tub and shower fixtures are located, a back wall 104 generally forming a right angle with the front wall 102, and a rear wall 106 located opposite and facing the front wall 102. A conventional tub 108 is sized to snugly fit within the space provided by the front wall 102, the back wall 104, and the rear wall 106. A shower curtain-rod assembly in accordance with the principles of the invention is generally indicated at reference numeral 110 in the various figures of the attached drawings wherein numbered elements in the figures correspond to like numbered elements herein.

The shower curtain-rod assembly 110, in accordance with a preferred embodiment of the invention, includes a flexible shower curtain 112 attached to stays 114, which may be alternatively referred to as supports or ribs. The stays 114 include a bowed or curved portion 118 so that the stays 114, when supported by a shower rod 116, urge the shower curtain 112 outward away from the back wall 104. Accordingly, the curved stays 114 provide additional maneuvering room within the shower region 100 compared to a conventional shower curtain that hangs from a shower rod without stays or which is supported from the shower rod with substantially straight stays. In addition, the stays 114 include substantially straight upper and lower end portions 120*a*, 120*b*. The upper end portion 120*a* includes an attachment mechanism for coupling to the shower rod 116 as will be explained in greater detail below. The lower end portion 120*b* extends downward by an amount that is sufficient to insure that the bottom edge of the shower curtain 112 is retained in the tub 108 as will be understood by those of ordinary skill in the art.

The shower rod 116 includes end couplings 122 for attaching the rod to the front wall 102 and back wall 104. In addition, the shower curtain-rod assembly 110 may include at least one end-stay 124 having a weighted, magnetized, or other mechanism for maintaining a front edge of the shower curtain 112 sufficiently against the front wall 102, thereby keeping the water from escaping the enclosed shower region 100 during a shower.

Figure 3:
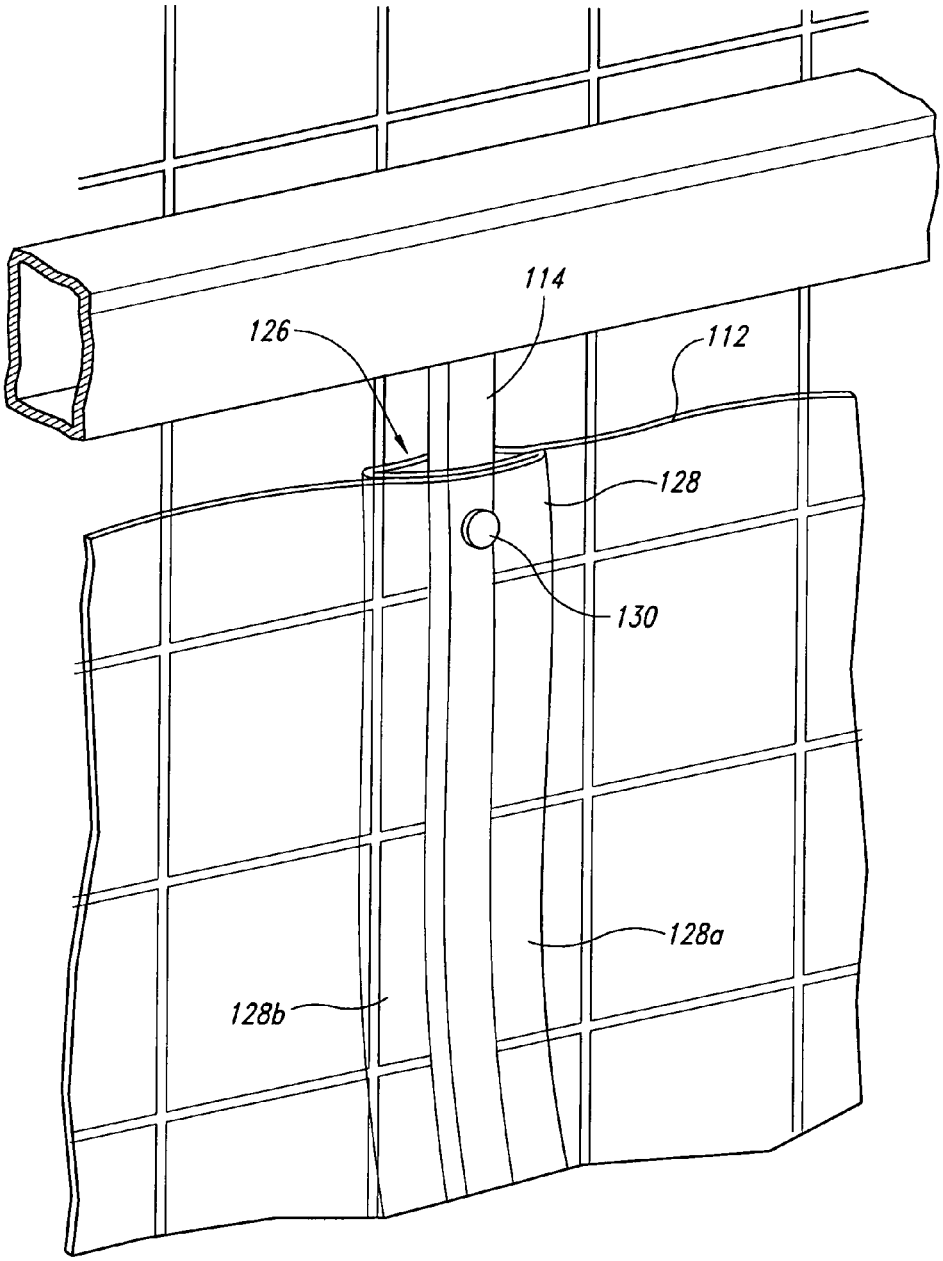
FIG. 3 is a perspective view of a shower curtain configured with folded pockets to receive shower curtain stays according to the illustrated embodiment.

FIG. 3 shows the shower curtain 112 attached to one of the stays 114. The shower curtain 112 is continuous about its height and width and includes folded pockets 126 for receiving the stays 114. The pockets 126 preferably extend the entire height of the shower curtain 112 and are formed with ultrasonic welds 128, where a front weld 128*a* forms a front portion of the pocket 126 and a rear weld 128*b* forms a rear portion of the pocket 126. As an alternative to forming the pocket 126 using ultrasonic welds 128, the pocket 126 may be formed by other available means such as using heat, pressure, adhesive, rivets, or some combination thereof. In addition, buttons or rivets 130, preferably made of a polymeric material, may be used to secure the shower curtain 112 to the stays 114.

Figure 4:
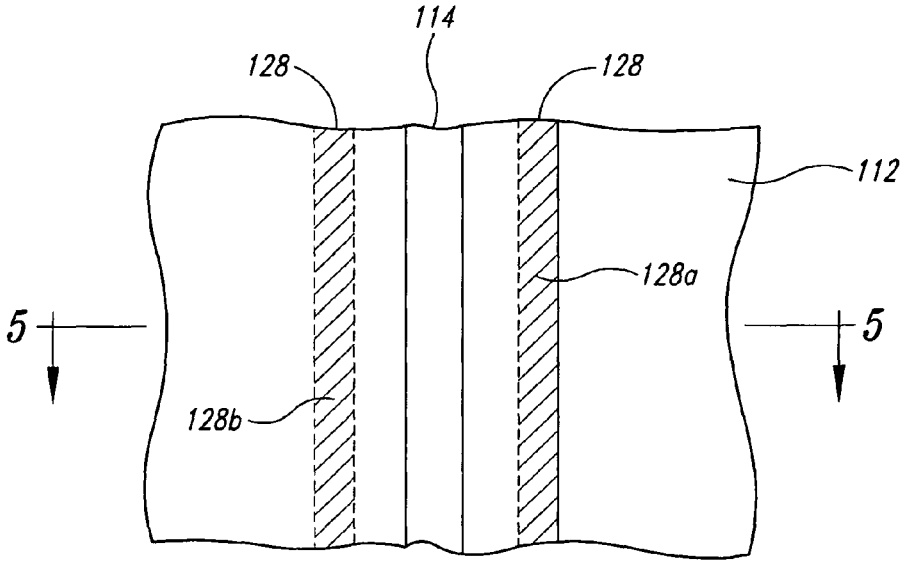
FIG. 4 is a partial side elevational view of the shower curtain of FIG. 3 showing overlapping portions of the shower curtain which are used to form the folded pockets.
Figure 5:
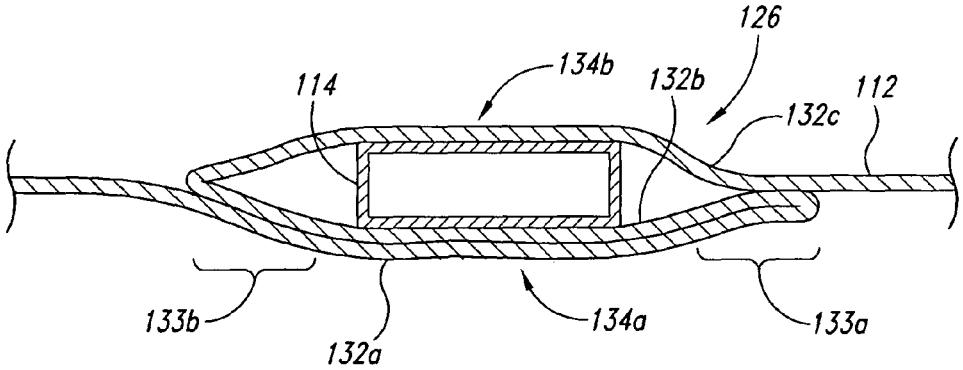
FIG. 5 is a cross-sectional view of the portion of the shower curtain of FIG. 4 taken along line 5-5 of FIG. 4.

FIGS. 4 and 5 show additional details of the pockets 126 of the shower curtain 112. Specifically, FIG. 4 shows a side, elevational view of a portion of the shower curtain 112. The pocket 126 includes a first layer 132*a*, a second layer 132*b*, and a third layer 132*c* where the layers are coupled together to form a first portion 133*a* and a second portion 133*b*. In one embodiment, the first portion 133*a* and the second portion 133*b* are formed by ultrasonically welding the three layers 132*a*, 132*b*, and 132*c* of the shower curtain 112 together. In another embodiment, the three layers 132*a*, 132*b*, and 132*c* are bonded or thermally pressed together. The first layer 132*a* positioned against the second layer 132*b* provides the curtain 112 with improved strength and tear resistance. FIG. 5 is a cross section of the portion of the shower curtain 112 shown in FIG. 4 and better illustrates an exemplary configuration of the folded pocket 126. Preferably, the folded pocket 126 includes a exterior side 134*a* and an interior side 134*b*. However, it is appreciated that either side 134*a*, 134*b* can face the shower region and thus be exposed to the water therein.

The three respective layers 132*a*, 132*b*, and 132*c* are coupled together at regions 133*a*, 133*b* as described above to form the pocket 126. The rivets 130 preferably pass through both the first layer 132*a* and the second layer 132*b* to engage the stay 114. The pocket 126 is sized to receive one of the stays 114, which is illustrated as having a rectangular cross section, but may have other cross-sectional configurations. In one embodiment, the stays 114 are hollow and are inserted into the pockets 126 after the pockets 126 have been formed. In an alternate embodiment, the each stay 114 is successively held in situ on the shower curtain 112 as the pockets 126 are folded and welded.

Figure 6:
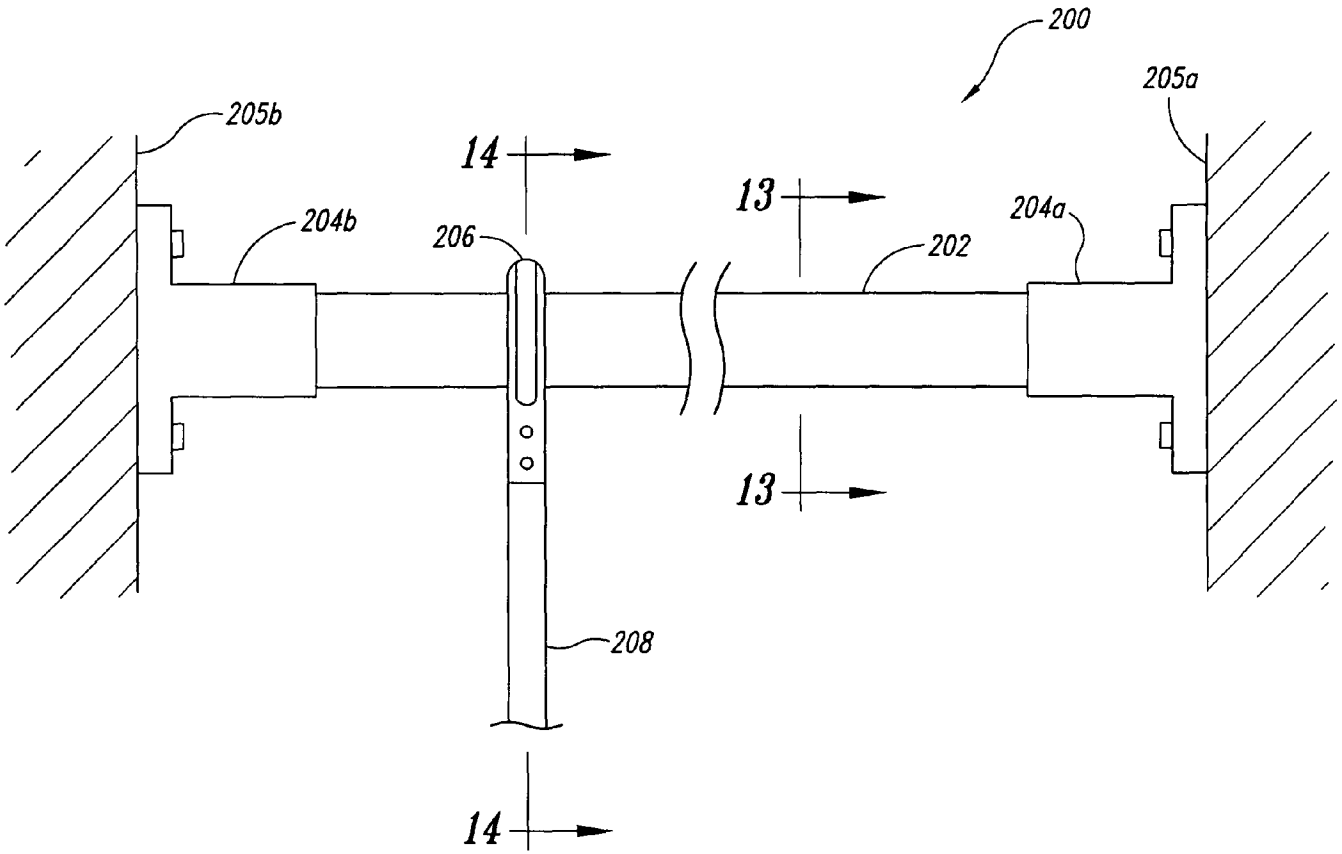
FIG. 6 is a side elevational view of a shower curtain-rod assembly having a shower rod with end couplings coupled to respective shower walls and a shower ring slideably received on the shower rod and coupled to a shower curtain stay according to the illustrated embodiment.

FIG. 6 shows a shower curtain-rod assembly 200 having a shower rod 202 engaged with respective end couplings 204*a*, 204*b*, which are fastened to first and second walls 205*a*, 205*b*. A shower rod ring 206 fits over and slides along the shower rod 202. A stay 208 is coupled to the shower ring 206. In the illustrated embodiment, the shower rod 202 appears truncated or shortened for simplicity and clarity only. Generally, the shower rod 202 would be substantially longer with an overall length that permits at least six or more shower rings 206 to be located on the shower rod 202.

Figure 7:
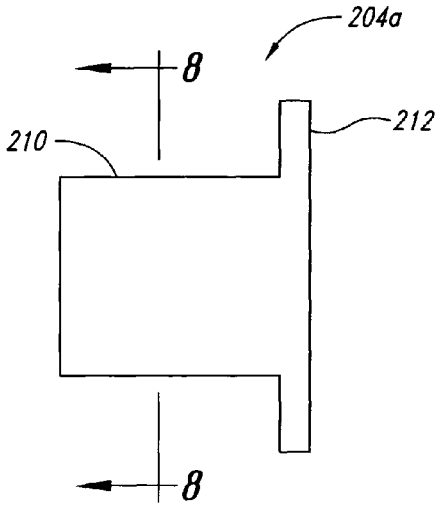
FIG. 7 is a side elevational view of the first end coupling of FIG. 6.
Figure 8:
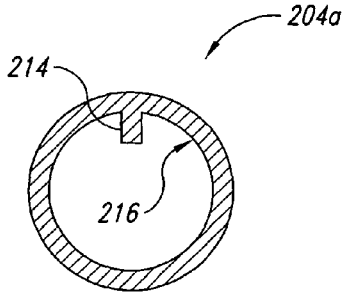
FIG. 8 is a cross-sectional view of the first end coupling of FIG. 6 taken along line 8-8 of FIG. 7.

FIGS. 7-10 show the end couplings 204*a*, 204*b*. In FIGS. 7 and 8, a first end coupling 204*a* includes a body 210 and a wall attachment flange 212. In one embodiment, openings in the wall attachment flange 212 are provided so that the first end coupling 204*a* may be mechanically fastened to a wall, with screws for example. Additionally or alternatively, the first end coupling 204*a* may be bonded to the wall.

In the embodiment shown in FIGS. 6-14, the body 210 includes a tab or key 214 that projects radially inward from an inner surface 216 of the body 210. The tab 214 functions as an anti-rotation or torsional restraint mechanism that engages an upper channel 250 (see FIGS. 13 and 14) formed in the shower rod 202. Thus, torsional loads applied to the shower rod 202 will be transferred to the first end coupling 204*a* and reacted into the wall via whatever mechanical attachment is used to attach the first end coupling 204*a* to the wall. The tab 214 may be sized to be closely received in the upper channel of the shower rod 202, which may prevent even small amounts of movement or rotation of the shower rod 202 with respect to the wall after installation is complete.

In the embodiment shown in FIGS. 1-3, the cross-sectional shape of the body 210 is non-circular, for example square, rectangular, etc. In turn, the shower rod 202 includes a cross-sectional shape complementary to that of the body 210. By way of example, the shower rod 202 has a rectangular cross-sectional shape that is received into the rectangular shaped body 210 of the first end coupling 204*a*. Consequently, torsional loads applied to the shower rod 202 will be transferred to the first end coupling 204*a* and reacted into the walls 205*a*, 205*b*.

Figure 9:
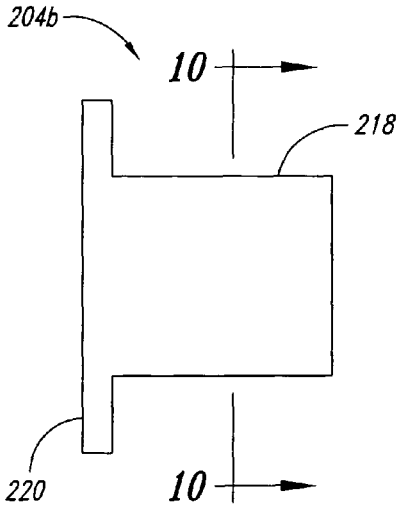
FIG. 9 is a side elevational view of the second end coupling of FIG. 6.
Figure 10:
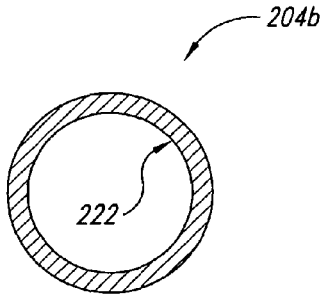
FIG. 10 is a cross-sectional view of the second end coupling of FIG. 6 taken along line 10-10 of FIG. 9.

FIGS. 9 and 10 show a second end coupling 204*b* having a body 218 and an attachment flange 220. Similar to the first end coupling 204*a*, the attachment flange 220 may include openings to receive screws for attaching the second end coupling 204*b* to an opposing wall. In one embodiment, an inner surface 222 of the second end coupling 204*b* is internally threaded to receive external threads formed on one end of the shower rod 202.

Figure 11:
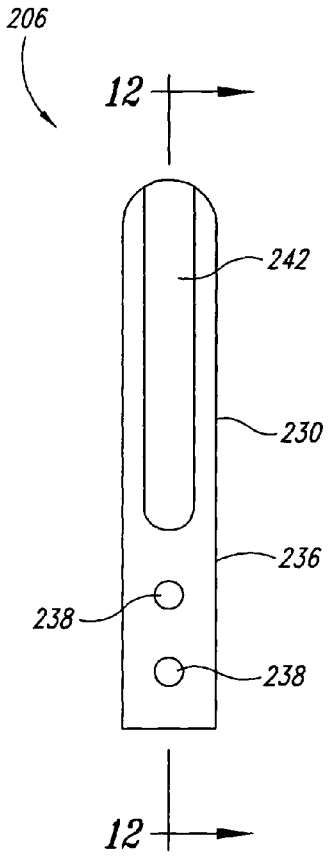
FIG. 11 is a side elevational view of the shower ring of FIG. 6.
Figure 12:
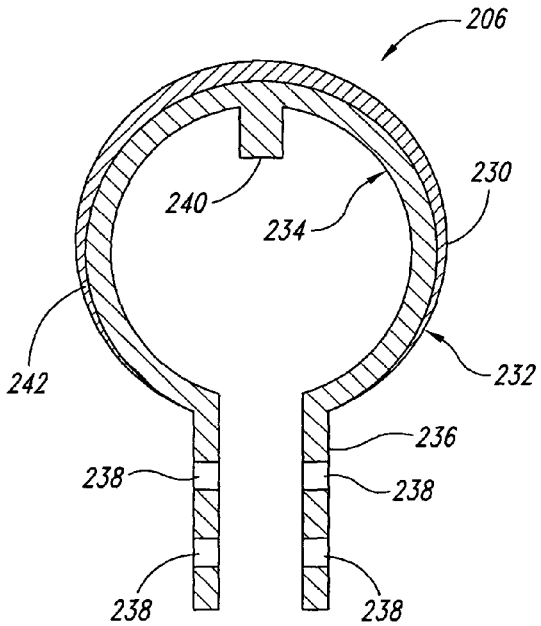
FIG. 12 is a cross-sectional view of the shower ring of FIG. 6 taken along line 12-12 of FIG. 11.

FIGS. 11 and 12 show the shower ring 206 coupled to the stays 208, which are supported on a track within the shower rod 202, as will be described in greater detail below. The shower rings 206 permits the shower curtain 112 to be slid from an open position to a closed position, or vice-versa, along the shower rod 202. In addition, the shower rings 206 operate as torsional or rotational restraint mechanisms to maintain the shower curtain 112 in a desired alignment and to react any net force on the shower curtain 112 that tends to urge the shower curtain toward the bather.

The shower ring 206 includes an outer surface 232 having an external profile that may be circular, oval, square, rectangular, etc. and an inner surface 234, which may include an internal profile that approximates the external profile of the outer surface 232. A pair of coupling extensions 236 extend from a bottom portion of the ring 206 and include openings 238 for fastening to the stays 208 such as by rivets. The shower ring 206 includes a torsional restraint projection or tab 240. The shower ring 236 may be a unitary structure or may be made from more than one type of material. For example, the shower ring 206 may include an outer covering or coating 242 made of plastic or rubber, such as an overmolded rubber, to make the shower ring 206 easier to grip and slide along the shower rod 202.

In another embodiment, the shower ring 206 is a non-circular ring with a cross-sectional shape complementary to the shape of the shower rod 202, for example a rectangular support 206 to fit over a rectangular shower rod 202. In this embodiment, the shower ring 206 still includes the coupling extensions 236, but does not include the torsional tab 240, where the latter is not needed because the rectangular shower ring 206 would be unable to substantially rotate relative to the rectangular shower rod 202. It is appreciated that a clearance will be present between the inner surface 234 of the shower ring 206 and the outer perimeter of the shower rod 202, so that the shower rings 206 may be easily slid along the shower rod 202.

Figure 13:
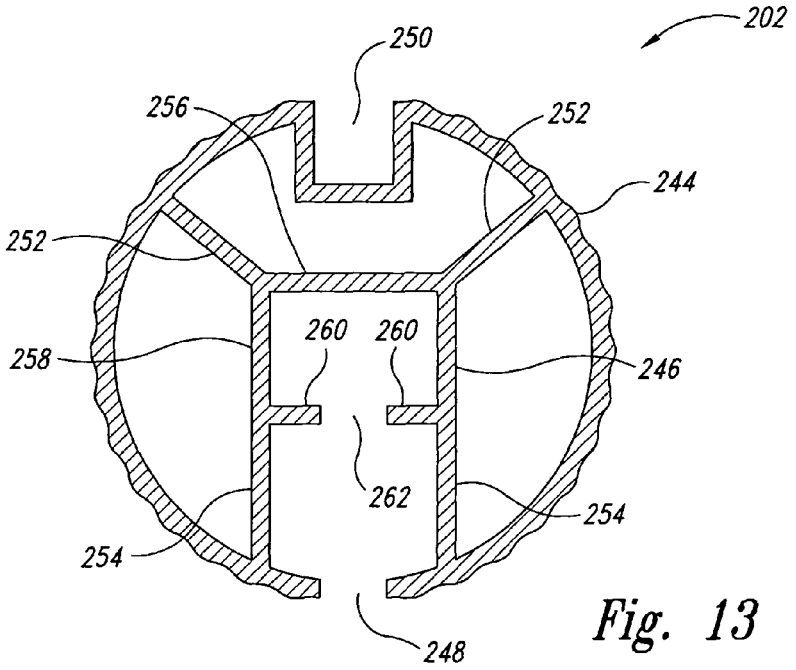
FIG. 13 is a cross-sectional view of the shower rod of FIG. 6 taken along line 13-13 of FIG. 6.

FIG. 13 shows a cross-sectional view of the shower rod 202 taken from the shower curtain-rod assembly 200 along line 13-13 of FIG. 6. The shower rod 202 is shown as a unitary, extruded circular rod having an outer wall 244 and an inner track 246. The outer wall 244 includes a through opening 248 sized to receive the stay 208 into the shower rod 202 and a channel 250 configured to receive the torsional restraint tab 240 (FIG. 12) of the shower ring 206. The inner track 246 is coupled to the outer wall 244 with upper support ribs 252 and lower support legs 254.

The inner track 246 has approximately a U-shaped or rectangular-shaped (e.g., door-shaped) cross section formed by an upper support member 256 connected to side support members 258. In addition, the inner track 246 includes a support shelf or ledge 260 having an opening 262. The support shelf 260 is generally located where the side support members 258 intersect or extend into the lower support legs 254.

Figure 14:
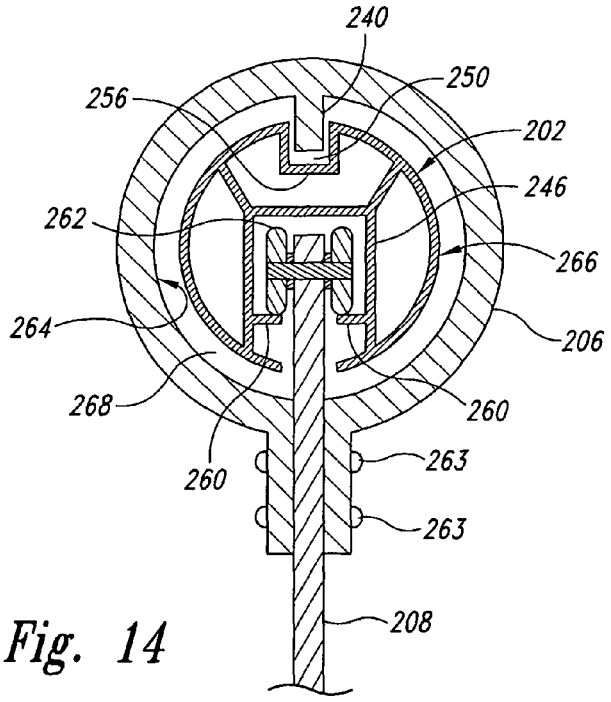
FIG. 14 is a cross-sectional view of the shower rod-curtain assembly of FIG. 6 taken along line 14-14 of FIG. 6 showing the separate load bearing capabilities of the shower rod-curtain assembly.

FIG. 14 shows a cross-sectional view of the shower curtain-rod assembly 200 taken along line 14-14 of FIG. 6. One purpose of the assembly 200 is to separate the gravitational load bearing aspect from the torsional load bearing aspect of the shower rod 202. The shower rod 202 supports its own weight plus the weight of both the stay 208 and the shower ring 206 on the support shelf 260 of the inner track 246 located within the shower rod 202. Meanwhile, the shower rod 202 rotationally restrains the shower curtain via the engagement of the torsional restraint tab 240 of the shower ring 206 against sides of the channel 250. Preferably the tab 240 does not contact or rest on the horizontal support member 256, which is part of the inner track 246, in any significant weight bearing manner.

The aforementioned purpose is advantageously achieved by a pair of rollers 262 coupled to an upper end portion of the stay 208, such as with rivets 263, and where the rollers 262 are supported on the shelf 260 of the inner track 246. In turn, the stay 208 is coupled to the shower ring 206 so that an inner surface 264 of the shower ring 208 is generally not in contact with an outer surface 266 of the shower rod 202. Thus, the rollers 262 being supported on the shelf 260 results in a gap or space 268 between the inner surface 264 of the shower ring 206 and the outer surface 266 of the shower rod 202. Even with the shower ring 206 not in physical contact with the shower rod 202, rotation of the shower ring 206 relative to the shower rod 202 is limited because of the torsional restraint tab 240 positioned in the channel 250 of the shower rod 202. Accordingly, a torsional load on the shower ring 206, for example from an inward force applied to the stays 208, is reacted into the shower rod 202, thus causing the shower ring tab 340 to contact the walls of the channel 250 formed in the shower rod 202. As noted earlier, these torsional loads are then transmitted to the end couplings and into the wall.

While the preferred embodiment of the invention has been illustrated and described, as noted above, many changes can be made without departing from the spirit and scope of the invention. For example, in some embodiments the torsional restraint capability of the shower rod assembly is achieved by employing a shower rod having a non-circular cross sectional shape. Accordingly, the scope of the invention is not limited by the disclosure of the preferred embodiment. Instead, the invention should be determined entirely by reference to the claims that follow.

I claim:

1. A shower curtain-rod assembly, comprising:
a shower curtain rod;
a shower curtain;
a shower curtain stay coupled to the shower curtain;
a shower curtain ring translationally coupled to the rod and coupled to the stay;
assembly weight bearing means located within the rod for gravitationally and translationally supporting the shower curtain-rod assembly with respect to the rod; and
torsional restraint means cooperatively formed by the ring and the rod for substantially restricting axial rotation of the stay relative to the rod and substantially decoupled from the assembly weight bearing means.

2. The assembly of claim 1 wherein the rod includes an inner track for gravitationally supporting the shower curtain-rod assembly.

3. The assembly of claim 1 wherein the assembly weight bearing means gravitationally supports at least the shower curtain, the stay, the rod, and the ring.

4. The assembly of claim 1 wherein the ring is maintained in a spaced apart relationship from the rod by assembly weight bearing means.

5. The assembly of claim 4 wherein the torsional restraint means transfers torsional loads from the ring to an outer wall of the rod while the assembly weight bearing means is decoupled from the torsional loads.

6. A shower curtain-rod assembly, comprising:
a shower curtain having a vertically oriented pocket;
a shower curtain stay received within the pocket of the shower curtain, the shower curtain stay having an arcuate portion and a straight portion;
an elongated shower rod having an outer perimeter; and
a shower ring coupled to the straight portion of the shower curtain stay, the shower ring sized to fit over and be slideably moveable along the outer perimeter of the elongated shower rod, the shower ring having an anti-rotation mechanism for cooperation with the shower rod to substantially prevent rotation of the shower ring relative to the elongated shower rod.

7. The assembly of claim 6 wherein the pocket includes two layers of the shower curtain arranged on a first side of the pocket and a single layer of the shower curtain arranged on a second side of the pocket.

8. The assembly of claim 6 wherein the elongated shower rod includes an internal track to gravitationally support the shower curtain stay.

9. The assembly of claim 8 wherein the shower curtain stay is coupled to rollers, which are supported on the internal track to facilitate movement of the shower curtain from an open to a closed position and vice-versa.

10. The assembly of claim 6 wherein the arcuate portion of the shower curtain stay is bowed outwardly so as to maintain the shower curtain in a bowed out configuration.

11. The assembly of claim 6 wherein an outer wall of the shower curtain-rod includes a substantially circular cross-sectional shape.

12. The assembly of claim 6 wherein the shower ring includes an inwardly directed tab and wherein the elongated shower rod includes an elongated groove to engage the tab of the shower ring to prevent substantial coaxial rotation of the shower ring relative to the rod.

13. The assembly of claim 6 wherein the shower ring is sized to fit over and be slideably moveable along the outer perimeter of the elongated shower rod, and the rod includes a weight supporting structure that maintains the shower ring in a spaced apart relationship from the outer perimeter of the elongated shower rod.

14. A method of supporting a shower curtain, the method comprising:
receiving a plurality of stays into respective pockets formed in a shower curtain;
coupling the shower curtain to the stays;
coupling a first portion of each of the stays to respective shower rod rings;
preventing substantial coaxial rotation of the rings with respect to a shower rod with a torque reaction mechanism cooperatively formed in the rings and in the rod;
gravitationally supporting the rings on a track located within the shower rod, the track substantially decoupled from the torque reaction mechanism.

15. The method of claim 14 wherein preventing substantial coaxial rotation of the rings with respect to the shower rod with the torque reaction mechanism cooperatively formed in the rings and in the rod includes engaging a tab of the shower ring in an upper groove of the shower rod to substantially prevent rotation of the shower ring relative to the shower rod, and gravitationally supporting the stays on the track of the shower rod is achieved by supporting a pair of rollers coupled to the stays on the track.

16. The method of claim 14 wherein gravitationally supporting the stays on the track of the shower rod supporting the shower rod rings in a spaced apart relationship from the shower rod.

* * * * *